US005134822A

United States Patent [19]

Edlin

[11] Patent Number: 5,134,822

[45] Date of Patent: Aug. 4, 1992

[54] WALL COVERING ASSEMBLY

[76] Inventor: Richard Edlin, 4615 Alonzo Ave., Encino, Calif. 91316

[21] Appl. No.: 679,474

[22] Filed: Apr. 2, 1991

[51] Int. Cl.[5] ..... A47H 23/00; E04F 19/02

[52] U.S. Cl. ..... 52/273; 160/327; 160/395; 52/100; 52/145; 52/DIG. 13

[58] Field of Search ..... 52/273, 716, DIG. 13, 52/144, 145, 222, 100; 160/392, 395, 327

[56] References Cited

U.S. PATENT DOCUMENTS

| | | | |
|---|---|---|---|
| 3,583,057 | 6/1971 | Kolozsvary | 52/DIG. 13 |
| 4,018,260 | 4/1977 | Baslow | 160/374.1 |
| 4,167,977 | 7/1979 | Baslow | 160/381 |
| 4,197,686 | 4/1980 | Baslow | 52/273 |
| 4,201,359 | 5/1980 | Baslow | 52/716 |
| 4,625,490 | 12/1986 | Baslow | 52/222 |
| 4,744,189 | 5/1988 | Wilson | 52/DIG. 13 |

*Primary Examiner*—James L. Ridgill, Jr.
*Attorney, Agent, or Firm*—John J. Posta, Jr.

[57] ABSTRACT

The wall covering assembly includes a flexible, resilient, preferably sound-deadening, fire-resistant sheet of wall covering, preferably of plastic and/or cloth. The assembly also includes one or a spaced number of preferably parallel wall covering anchoring strips releasably connected to the rear of the wall covering. The strips can be anchored to the exposed surface of a wall to hold the wall covering over and spaced from the wall. Each strip may be of plastic, wood, metal, ceramic or the like and includes a rear base plate adapted to be connected, as by adhesive, screws, etc. to a wall. It also includes a front plate spaced forward of the base plate by integral struts, preferably parallel therewith and defining therebetween an acoustical space. The front plate bears anchoring hooks attachable to the rear of the wall covering. Preferably, the strips bear breakaway segments on one side thereof, removably blocking access to the space. When the segments are removed, ends of the wall covering can be reflected into the space. Segment-bearing sides may be flat, rounded or tapered. The assembly permits rapid efficient attachment of acoustical coverings to walls.

A prefabricated panel can be constructed using a baseboard with strips secured to the top, and a wall covering secured at its ends to the strips. The baseboard has hanging members for securing the panel to a wall.

17 Claims, 2 Drawing Sheets

WALL COVERING ASSEMBLY

BACKGROUND OF THE INVENTION

1. Field of the Invention

The present invention generally relates to wall covering assemblies and more particularly to an improved assembly which provides acoustical properties and enables a wall covering to be smoothly reflected over an irregular wall surface.

2. Prior Art

Various systems have been provided for covering walls. Usually, walls are merely painted. In some instances they are covered with wall paper or wall cloth. In other instances they are covered with rigid acoustical or non-acoustical paneling. One recent assembly has employed flat plastic strips bearing hooks on their exposed surfaces. The strips are adhesively connected to a wall or screwed in place, after which a flexible wall covering is hooked to the strips to closely overlie the wall. Although this system is an improvement over many other wall covering systems, it does have some drawbacks. Thus, wall surface irregularities show through the closely overlying wall covering, necessitating the use of a perfectly flat wall for best results. Moreover, although the wall covering itself may be acoustical, its placement against the wall does not enhance such properties. Hence, the covering must be relatively thick to have significant sound-deadening properties.

There remains a need for an improved wall covering assembly which can overcome the above-described shortcomings. Such assembly should not only result in improved acoustical properties, but should allow the wall covering to be perfectly smoothly applied to an irregular wall surface. The assembly should be inexpensive, adaptable to a variety of applications, efficient and durable.

SUMMARY OF THE INVENTION

The improved wall covering assembly of the present invention satisfies all the foregoing needs. The assembly is substantially as set forth in the Abstract of the Disclosure. Thus, the assembly comprises a flexible resilient wall covering which may be of plastic, cloth or the like and may be acoustical and fire retardant.

The assembly further includes one or a plurality of wall covering anchoring strips. Each strip has a generally flat base plate, and a generally flat front plate spaced well in front of the base plate by integral struts, the two plates and struts defining therebetween an acoustical space. The front plate bears on its front surface a plurality of spaced hooks releasably engaging the rear of the wall covering to hold it in place spaced in front of a wall, when the base plates are anchored to the wall, as by adhesive, screws, bolts or the like.

Each strip bears a breakaway segment on or near one side thereof, which segment removably blocks access to the acoustical space. When the segment is removed, the edge of the wall covering can be reflected into the acoustical space, in order to provide the assembly with a neat and orderly appearance. Preferably, the opposite side of each strip is flat, that is, perpendicular to the front and base plates, while the segment-bearing side of the strip may be rounded, flat or sloped (mitered) for improved appearance.

Since the front and base plates are well apart from each other and a sound-deadening acoustical space is disposed therebetween, the wall covering is held well in front of the wall and does not show through it any wall irregularities. Moreover, the acoustical properties of the wall covering assembly are improved.

Another embodiment of the invention provides for forms, a series of prefabricated panels of wall coverings, adapted to be arranged on a wall and secured in place thereto. These panels can be assembled by securing a pair of opposed strips on a baseboard and securing the wall covering to the strips. The baseboard can have a plurality of wall mounting hooks secured to its underside, which can be attached to a wall, as by mating hooks. Such an assembly of prefabricated panels are easy to mount and provide an improved, neat appearance.

Various other features of the present invention are set forth in the following detailed description and accompanying drawings.

DRAWINGS

DETAILED DESCRIPTION

Figure 1:
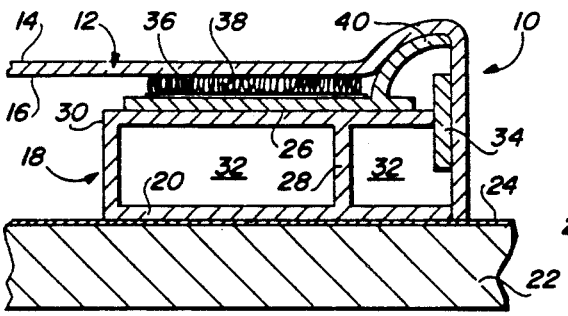
FIG. 1 is a schematic, fragmentary top plan view of a first preferred embodiment of the improved assembly of the present invention, shown in place on a wall.
Figure 6:
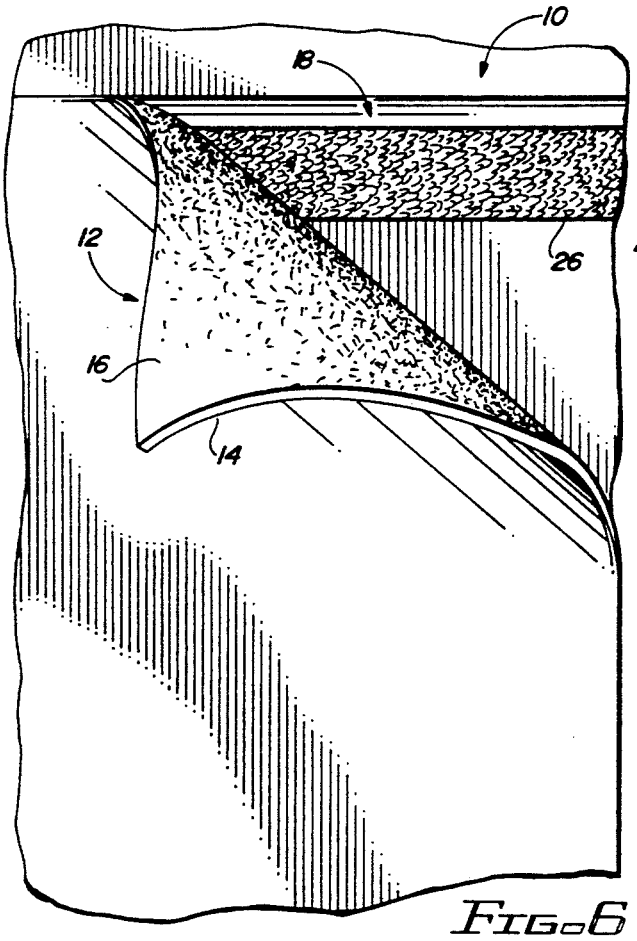

FIGS. 1 and 6

Now referring more particularly to FIGS. 1 and 6 of the drawings, a first preferred embodiment of the improved wall covering assembly of the present invention is schematically depicted therein installed on a wall.

Thus, assembly 10 is shown which comprises a flexible resilient sheet 12 of wall covering material such as plastic, cloth or the like having a front 14 and rear 16, the latter being adapted to receive and releasably secure anchoring hooks or the like, as hereinafter described. Sheet 12 preferably is fire resistant, decorative and sufficiently thick to have sound-deadening or acoustical properties.

Assembly 10 also includes one or a spaced plurality of elongated wall covering anchoring strips 18, each comprising a generally flat rear or base plate 20, shown in FIG. 1 as anchored to the exposed surface of a wall 22 by a layer 24 of adhesive or the like. Alternatively, strip 18 could be anchored to wall 22 by bolts, screws or the like (not shown).

Strip 18 may be fabricated as a single, unitary structure from plastic, wood, metal, ceramic or the like. Strip 18 also includes a generally flat front plate 26 spaced forwardly of and generally parallel to plate 20 by integral perpendicular struts 28, one of which comprises a flat side wall 30. Plates 20 and 26 define with struts 28 one or more acoustical, sound-deadening spaces 32 which increase the acoustical properties of assembly 10. The side of strip 18 opposite sidewall 30 is covered by a removable breakaway section 34 perpendicular to plates 20 and 26 and blocking access to space 32.

The front surface 36 of plate 26 is provided with a spaced plurality of hooks 38 which releasably engage rear 16 of sheet 12 to anchor it in place spaced in front of wall 22. Moreover, plate 26 has a contoured end 40 around which sheet 12 is reflected.

It will be noted that space(s) 32 is sufficiently deep so that sheet 12 stands well away from wall 22 and thus does not show therethrough any irregularities in wall 22. Instead, sheet 12 presents a smooth, continuous uninterrupted surface which increases its decorative effect.

Accordingly, assembly 10 provides improved smoothness and continuity for wall covering sheet 12 and improved sound deadening properties, all at low cost and with ease of installation and use.

FIG. 2

Figure 2:
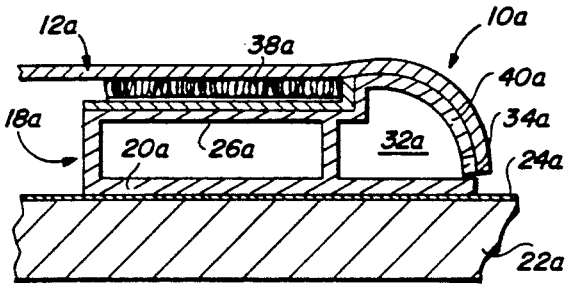
FIG. 2 is a schematic, fragmentary top plan view of a second preferred embodiment of the improved assembly of the present invention, also shown in place on a wall.

A second preferred embodiment of the present assembly is schematically shown in FIG. 2. Thus, assembly 10*a* is shown. Components thereof similar to those of assembly 10 bear the same numerals but are succeeded by the letter "a". Assembly 10*a* differs from assembly 10 only as follows:

a) contoured end 40*a* is fully rounded; and, b) breakaway section 34*a* is relatively small and a continuation of end 40*a*.

Assembly 10*a* has substantially the advantages of assembly 10.

FIG. 3

Figure 3:
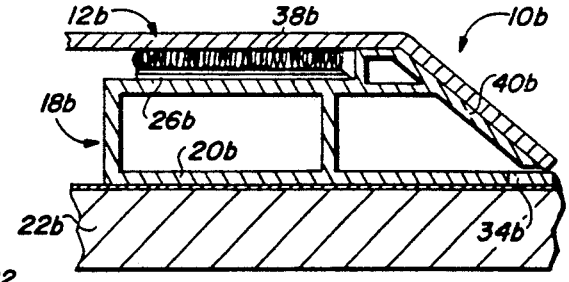
FIG. 3 is a schematic, fragmentary top plan view of a third preferred embodiment of the improved assembly of the present invention, shown in place on a wall.

A third preferred embodiment of the present assembly is schematically depicted in FIG. 3. Thus, assembly 10*b* is shown. Components thereof similar to those of assembly 10 bear the same numerals but are succeeded by the letter "b". Assembly 10*b* differs from assembly 10 only as follows:

a) breakaway section 34*b* is connected to base plate 20*b* near the rear extension of contoured end 40*b*, rather than to end 40*b*; and, b) end 40*b* is straight sloped from front to rear; that is, is mitered, rather than rounded.

Assembly 10*b* has substantially the advantages of assembly 10.

Figure 4:
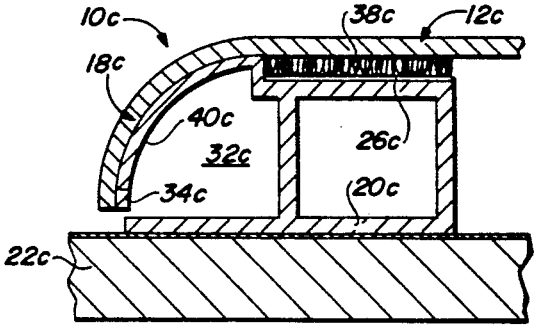
FIG. 4 is a schematic, fragmentary top plan view of a fourth preferred embodiment of the improved assembly of the present invention, shown in place on a wall, and with the breakaway section thereof in place.
Figure 5:
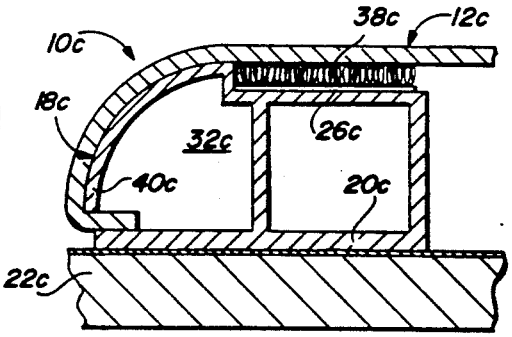
FIG. 5 is a schematic, fragmentary, top plan view of the assembly of FIG. 4, shown with the breakaway section thereof removed and with the edge of the wall cover reflected into the acoustical space thereof; and, FIG. 6 is a schematic front perspective view of the assembly of FIG. 1 on a wall, but with the wall cover pulled away from the anchoring strip.

FIGS. 4 and 5

A fourth preferred embodiment of the improved assembly of the present invention is schematically depicted in FIGS. 4 and 5. Thus, assembly 10*c* is shown. Components thereof similar to those of assembly 10*a* bear the same numerals but are succeeded by the letter "c". Assembly 10*c* is substantially identical to assembly 10*a* except in size and proportion of components.

FIG. 4 shows breakaway section 34*c* intact on end 40*c* while FIG. 5 shows breakaway section 34*c* removed and one end of sheet 12*c* reflected into space 32*c* through the resulting gap, in order to improve the aesthetic appearance of assembly 10*c*. Assembly 10*c* has substantially the same advantages as assembly 10*a*.

Figure 8:
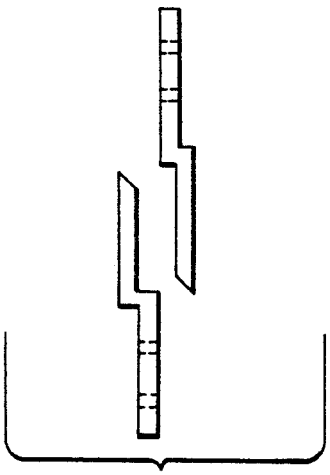
FIG. 8 is a side view of a pair of wall attachment hooks for use with the panel of FIG. 7.
Figure 7:
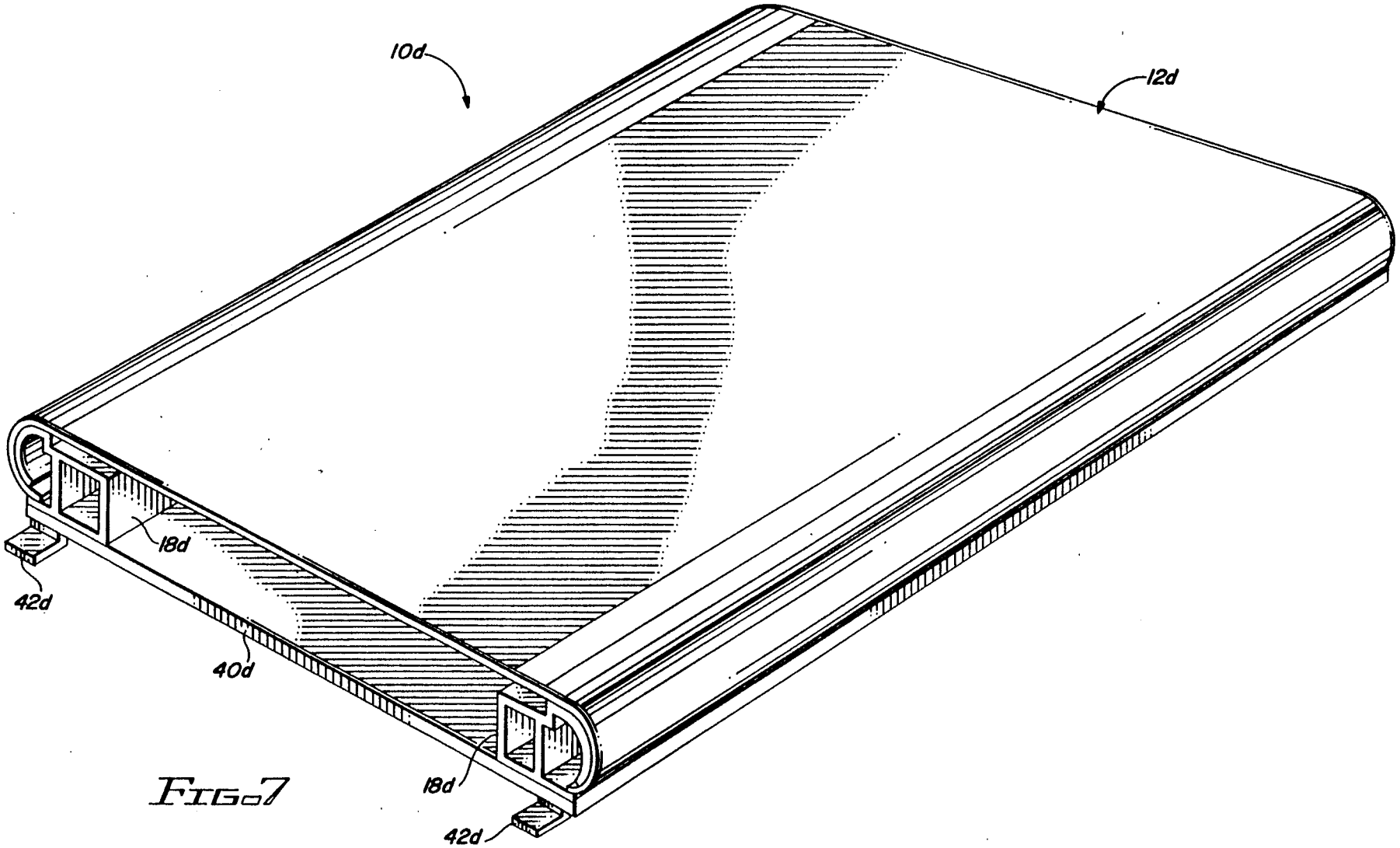
FIG. 7 is a schematic perspective view of another preferred embodiment of the invention showing a panel comprised of a baseboard, attached strips, wall covering and wall hooks.

FIGS. 7 and 8

A fifth preferred embodiment of the improved assembly of the present invention is depicted in FIGS. 7 and 8. Thus, assembly 10(*d*) is shown. Components thereof similar to those of assembly 10 bear the same numerals but are succeeded by the letter "d". Assembly 10*d* differs from assembly 10*c* in that a prefabricated panel assembly 10*d* is shown which includes a pair of strips 18*d* to which sheet 12*d* is secured, in the manner described above. However, a baseboard 40*d* is provided to which strips 18 are rigidly secured. A plurality of mounting means such as hooks 42*d* are secured to the bottom of baseboard 40*d* which are used to mount the panel 10*d* on a wall (not shown). Mounting hooks 42*d* are preferably secured to each cover on the bottom of baseboard 40*d* and can be adapted to mate with a revised mirror image hook 44*d* which can be secured to a wall. The use of prefabricated panels 10*d* allows fast and efficient mounting and creation of a decorative wall covering.

Various other modifications, changes, alterations and additions can be made in the improved assembly of the present invention, its components and parameters. All such modifications, changes, alterations and additions as are within the scope of the appended claims form part of the present invention.

What is claimed is:

1. An improved wall covering assembly, said assembly comprising, in combination:

a) a flexible resilient wall covering having a front and a rear; and, b) at least one wall covering anchoring strip releasably connected to the rear of said wall covering, each of said strips being adapted to be secured to the exposed surface of a wall to hold said covering over said wall, each of said strips comprising an integral 1) array of a generally flat base plate securable to a wall, 2) a front plate generally parallel to an spaced forwardly of said base plate to provide an acoustic space therebetween and fixed in place by 3) integral struts spanning said acoustic space, c) said front plate having a front surface bearing a spaced plurality of anchoring hooks releasably secured to the rear of said wall covering to hold said covering over said wall in a fixed acoustical decorative position, said anchoring strips bearing breakaway sections which block access to said acoustical space, said sections, when removed, allowing ends of said wall covering to be reflected into said acoustic space.

2. The improved assembly of claim 1 wherein said assembly includes a panel with a plurality of said strips being secured thereto in spaced relation to each other, said panel including panel hanging means to enable it to be attached to a wall.

3. The improved assembly of claim 1 wherein said strips comprise plastic.

4. The improved assembly of claim 1 wherein said wall covering comprises at least one of cloth and plastic and is fire retardant.

5. The improved assembly of claim 4 wherein said rear of said wall covering comprises hook-receptive material and wherein said wall covering has sound deadening properties.

6. The improved assembly of claim 1 wherein one side of each said strips is one of squared off, rounded and sloped.

7. The improved assembly of claim 6 wherein the two opposite sides of each said strip are perpendicular to said base plate and said front plate and one of said two sides bears a breakaway section perpendicular to said front and base plates.

8. The improved assembly of claim 6 wherein one side of each said strip is perpendicular to said base and front plates while the opposite side of each said strip is rounded and bears a breakaway section.

9. The improved assembly of claim 6 wherein one side of each said strip is perpendicular to said base and front plates and the opposite side of each said strip is sloped, and wherein said base plate adjacent said sloped side bears a breakaway section.

10. An improved wall covering assembly, comprising, in combination:

a) a wall covering having a front and a rear; and b) anchoring strips secured to a wall and to said covering, wherein said strip serves to position said covering substantially out of contact with the wall, said anchoring strips including i) a base plate and a front plate spaced forwardly of said base plate; and ii) struts interconnecting said base plate and front plate, said anchoring strips bearing breakaway sections which block access to said acoustical space, said sections, when removed, allowing ends of said wall covering to be reflected into said acoustic space.

11. The improved assembly of claim 11 wherein said strips comprise plastic.

12. The improved assembly of claim 10 wherein said wall covering comprises at least one of cloth and plastic and is fire retardant.

13. The improved assembly of claim 12 wherein said rear of said wall covering comprises hook-receptive material and wherein said wall covering has sound deadening properties.

14. The improved assembly of claim 10 wherein one side of each said strips is one of squared off, rounded and sloped.

15. The improved assembly of claim 14 wherein the two opposite sides of each said strip are perpendicular to said base plate and said front plate and one of said two sides bears a breakaway section perpendicular to said front and base plates.

16. The improved assembly of claim 14 wherein one side of each said strip is perpendicular to said base and front plates while the opposite side of each said strip is rounded and breaks a breakaway section.

17. The improved assembly of claim 14 wherein one side of each said strip is perpendicular to said base and front plates and the opposite side of each said strip is sloped, and wherein said base plate adjacent said sloped side bears a breakaway section.

* * * * *